United States Patent [19]

Greaves et al.

[11] Patent Number: 4,920,783

[45] Date of Patent: May 1, 1990

[54] HYDRAULIC PRESS

[75] Inventors: Brian Greaves, Kinver; Hugh M. Jenkins, Wombourne, both of England

[73] Assignee: Wyko Equipments Ltd., Dudley, England

[21] Appl. No.: 321,566

[22] Filed: Mar. 9, 1989

[30] Foreign Application Priority Data

Mar. 9, 1988 [GB] United Kingdom ..... 8805577

[51] Int. Cl.[5] ..... B21J 9/18

[52] U.S. Cl. ..... 72/454; 72/449; 72/453.03; 100/231; 100/270; 100/289

[58] Field of Search ..... 72/449, 454, 455, 453.04, 72/453.03, 1, 26, 389; 100/289, 288, 231, 214, 270, 271

[56] References Cited

U.S. PATENT DOCUMENTS

| | | | |
|---|---|---|---|
| 1,774,148 | 8/1930 | May | 72/454 |
| 1,850,073 | 3/1932 | Countryman | 72/454 |
| 1,869,225 | 7/1932 | Sircoulomb | 72/454 |
| 2,774,217 | 12/1956 | Ashton | 100/288 |
| 3,178,958 | 4/1965 | Beck | 100/289 |
| 3,468,173 | 9/1969 | Fracke | 100/288 |
| 3,686,922 | 8/1972 | Bley | 72/453.04 |
| 4,448,119 | 5/1984 | Williamson | 100/231 |

FOREIGN PATENT DOCUMENTS

| | | | |
|---|---|---|---|
| 1003429 | 3/1962 | United Kingdom | 100/289 |
| 895847 | 5/1962 | United Kingdom | 100/289 |

*Primary Examiner*—David Jones

*Attorney, Agent, or Firm*—Richard Bushnell

[57] ABSTRACT

An hydraulic press having a fixed tool carrier, a movable tool carrier, and a first rotatable shaft for generating movement of the movable tool carrier towards and away from the fixed tool carrier. The first shaft has its axis aligned with the direction of the movement of movable tool carrier, and a second rotatable shaft extends transverse to said first rotatable shaft, there being a drive transmission coupling said first and second shafts. An angularly movable, manual operating lever has, a centering device urging said lever to a central, rest position from which said lever is movable manually in opposite angular directions, and, there is provided a coupling mechanism for coupling said lever to said second shaft during angular movement of the lever in either direction from said central, rest position, said shaft being rotatable relative to said lever in said central, rest position.

3 Claims, 4 Drawing Sheets

HYDRAULIC PRESS

Figure 1:
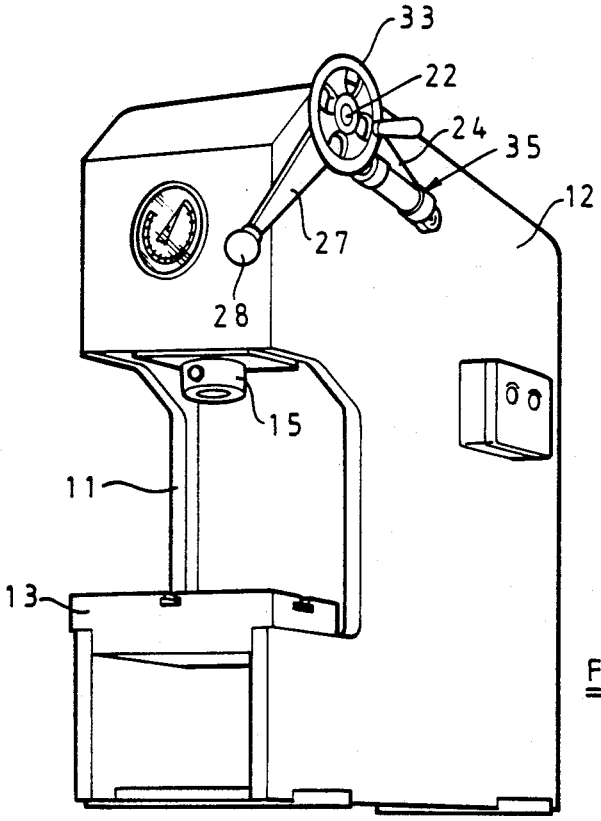

This invention relates to a manually controllable hydraulic press.

British patent number 2119682 discloses an hydraulic press which is manually controllable by rotation of a vertically extending shaft of an hydraulic control mechanism of the press. The shaft protrudes upwardly through the top of the housing of the press and secured thereto is a horizontally disposed hand wheel for effecting manual rotation of the shaft. Where there is no resistance to movement of the movable tool of the press then rotation of the hand wheel results, by virtue of a screw mechanism, in rectilinear movement of the movable tool of the press without any hydraulic assistance. However, immediately resistance to movement of the movable tool of the press is experienced then hydraulic assistance to movement of the movable tool is provided, the extent of the hydraulic assistance being determined by the torque applied to the rotatable shaft by the hand wheel. Thus taking as an example a rivet being trapped been the movable and fixed tools of the press then the more angular loading, and therefore torque, which is applied by the operator to the hand wheel the greater will be the hydraulic assistance and thus the loading applied by the movable tool to the rivet.

The press mechanism described in British patent 2119682 is particularly advantageous, but controlled by means of a hand wheel positioned above the top of the press housing is inconvenient, and it is an object of the present invention to provide an hydraulic press of the kind disclosed in British patent 2119682 incorporating a more convenient control mechanism.

In accordance with the present invention there is provided an hydraulic press having a fixed tool carrier, a movable tool carrier, a first rotatable shaft for generating movement of the movable tool carrier towards and away from the fixed tool carrier, said shaft having its axis aligned with the direction of the movement of the movable tool carrier, a second rotatable shaft extending transverse to said first rotatable shaft, drive transmission means coupling said first and second shafts, an angularly movable, manual operating lever, centering means urging said lever to a central, rest position from which said lever is movable manually in opposite angular directions, and, coupling means for coupling said lever to said second shaft during angular movement of the lever in either direction from said central, rest position, said shaft being rotatable relative to said lever in said central, rest position.

Preferably said lever is angularly movable about the axis of said second shaft.

Desirably said coupling means comprises first and second ratchet discs rotatable with said second shaft, respective first and second pawls carried by said lever and cooperable respectively with said first and second ratchet discs said first pawl cooperating with said first ratchet disc during clockwise angular movement of the lever so as to transmit such clockwise movement of the lever to said second shaft, said second pawl cooperating with said second ratchet disc during counter-clockwise movement of the lever so as to transmit such counter-clockwise movement of the lever to said second shaft, and, the coupling means further including pawl lifting means operable in the central rest position of the lever to disengage both of said first and second pawls from their respective ratchet discs.

Figure 3:
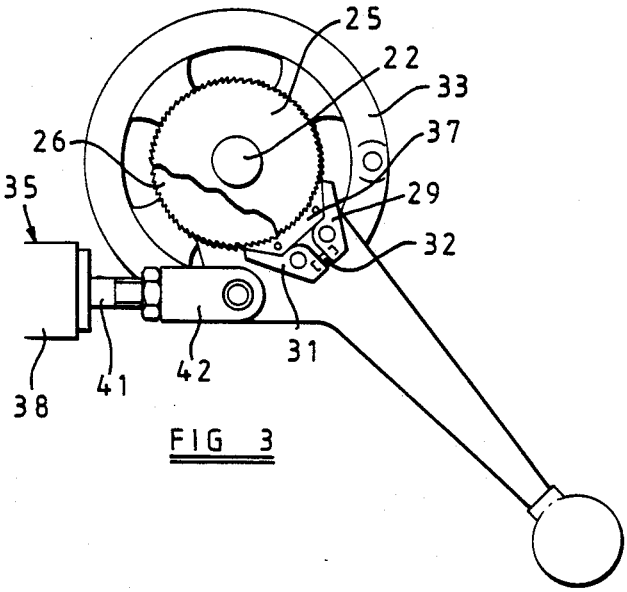
Figure 2:
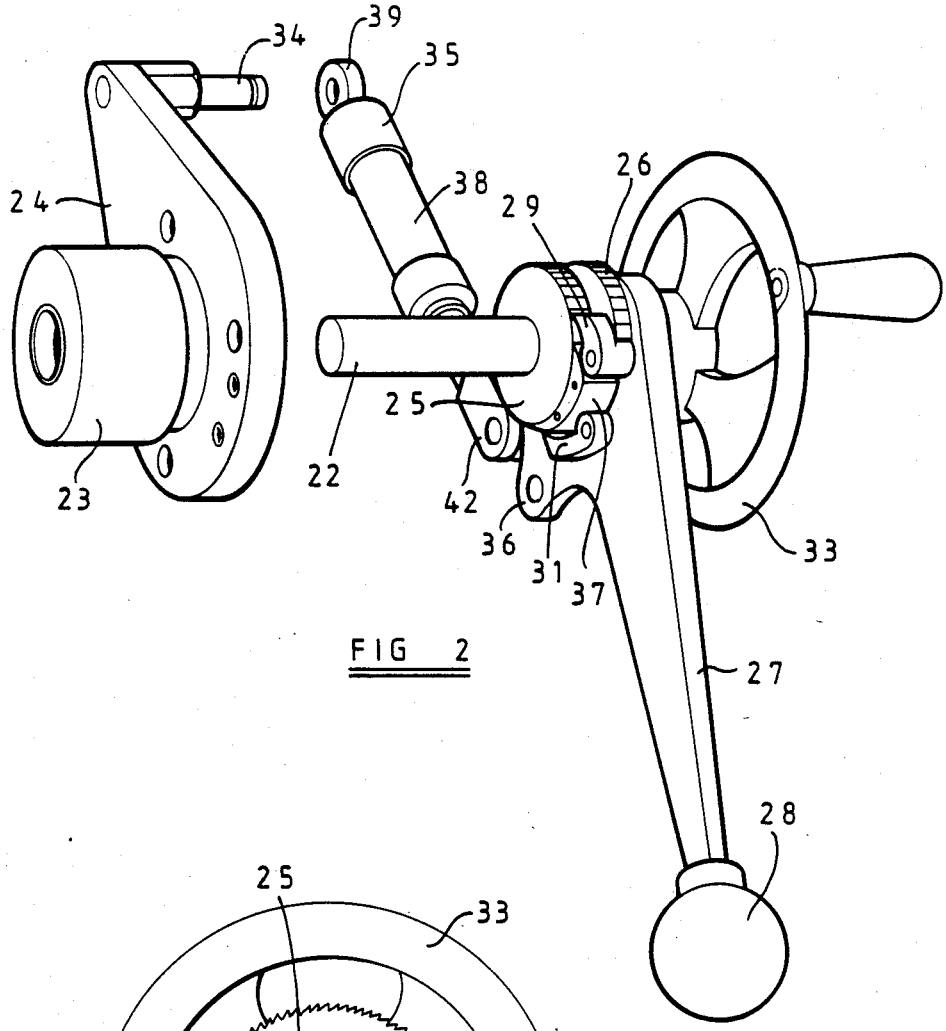
Figure 4:
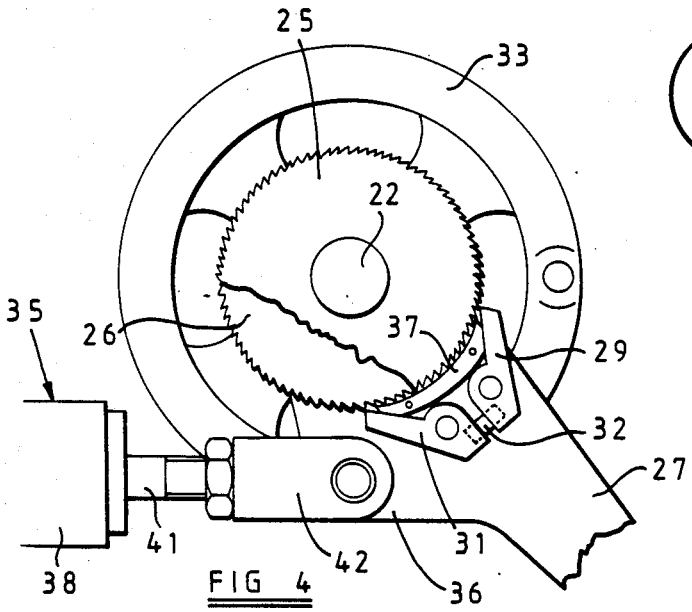
Figure 5:
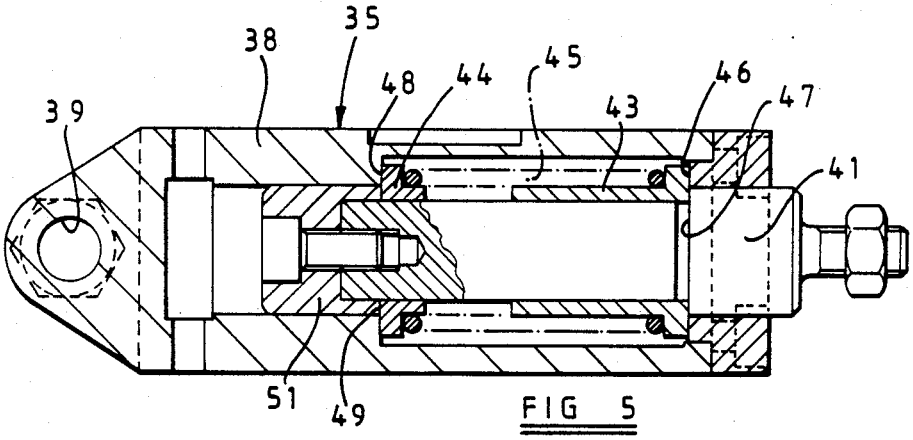
Figure 6:
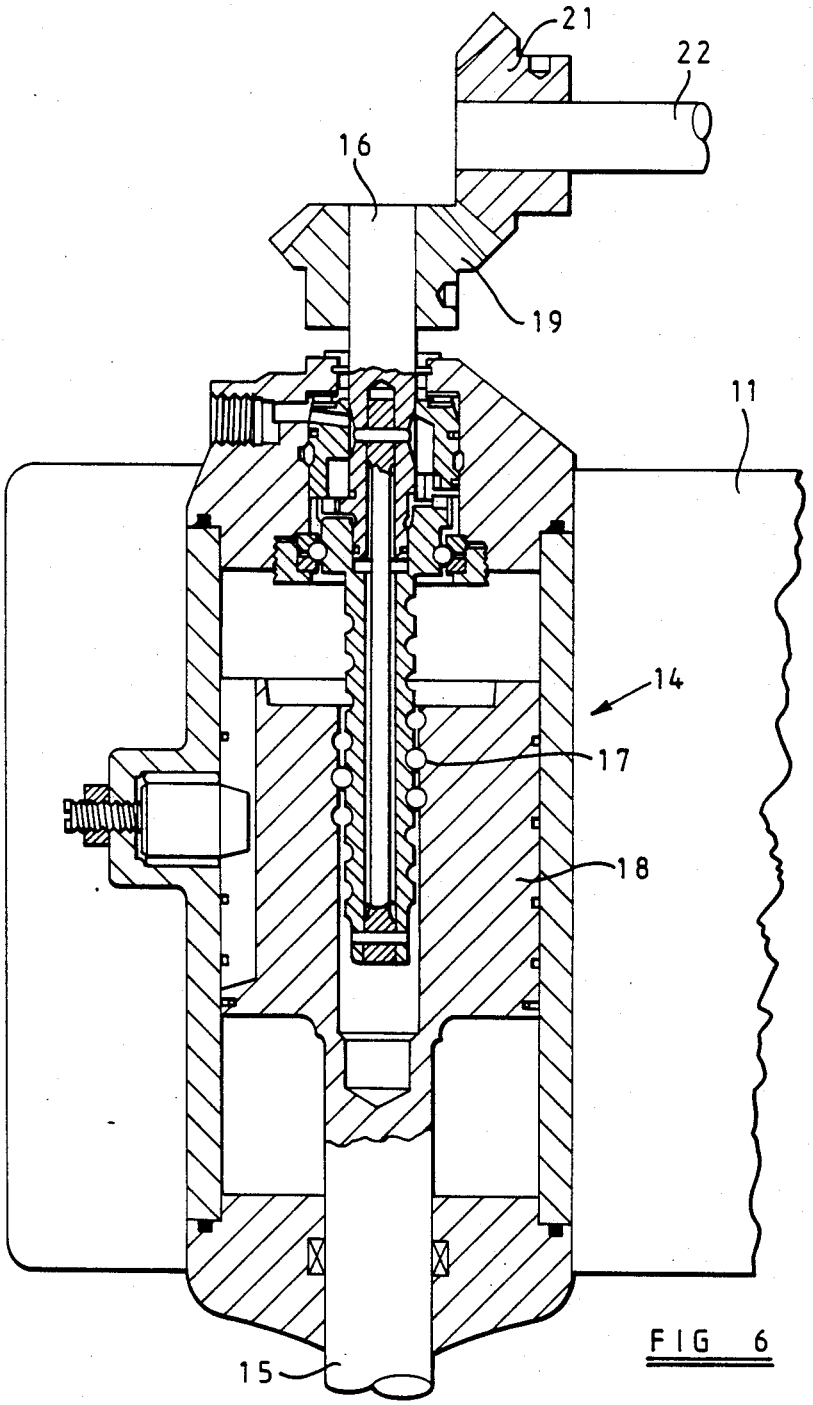

One example of the invention is illustrated in the accompanying drawings wherein, FIG. 1 is a diagrammatic perspective view of an hydraulic press, FIG. 2 is a partially exploded perspective view of part of the operating lever arrangement of the press of FIG. 1, FIG. 3 is an end view, partly in section of the arrangement illustrated in FIG. 2, FIG. 4 is an enlargement part of FIG. 3, FIG. 5 is a longitudinal sectional view of a centralizing unit of the lever arrangement illustrated in the preceding drawings, and FIG. 6 is a diagrammatic sectional representation of part of the operating mechanism of the press.

Referring to the drawings, the hydraulic press includes a C-shaped frame 11 partially enclosed by a sheet metal housing 12. The lower horizontal limb of the C-shaped frame 11 carries a rigid bed 13 constituting a fixed tool support, and the upper horizontal limb of the frame 11 carries an hydraulic assisted moving tool mechanism 14 including a moving tool carrier 15. The carrier 15 is movable vertically towards and away from the bed 13 in a rectilinear path, the carrier 15 extending from the lower end of the mechanism 14 and there being a rotatable shaft 16 extending from the upper end of the mechanism 14 co-axial with the carrier 15. A detailed understanding of the mechanism 14 is not of importance to the present invention, and the mechanism is fully described in British patent 2119682. However it is important to recognise that rotation of the shaft 16 gives rise to rectilinear movement of the carrier 15 towards or away from the bed 13 dependent upon the direction of rotation of the shaft 16. A ball screw and nut arrangement 17 is provided within the mechanism 14, and when there is no resistance to movement of the carrier 15, as would be the case when a press tool carried by the carrier 15 is spaced from the workpiece, then rotation of the shaft 16 is converted by the ball screw and nut mechanism 17 into linear movement of the carrier 15. There is no hydraulic assistance when there is no resistance to movement of the carrier 15. Assuming however that the tool carried by the carrier 15 is engaged with the workpiece, thereby giving rise to resistance to further movement of the carrier 15, then since there is resistance to movement of the carrier there will be resistance to operation of the ball screw and nut mechanism, and consequential resistance to rotation of the shaft 16. Application of torque to the shaft 16 in these circumstances causes an hydraulic control valve to be opened admitting hydraulic fluid under pressure to the upper side of a piston 18 coupled to the carrier 15. The admission of hydraulic fluid to the upper side of the piston 18 provides hydraulic assistance in moving the carrier 15, and in effect the force imparted by a operator to rotate the shaft 16 is greatly amplified by the hydraulic assistance to provide a high but corresponding load at the moving tool carried by the carrier 15.

In the arrangement disclosed in British patent 2119682 the shaft is rotatable by means of a hand wheel horizontally disposed at the exterior of the housing, and carried at the free end of the shaft. As is apparent from FIG. 6, in the press disclosed herein, the free end of the shaft 16 carries a 45° bevel gear 19 the teeth of which mesh with a second 45° bevel gear 21 secured to a second rotatable shaft 22. The shaft 22 extends at right angles to the shaft 16, and thus extends horizontally. The bevel gear pair constitute a drive transmission whereby rotation of the shaft 22 in either direction is transmitted to the shaft 16 at a 1:1 ratio.

The shaft 22 protrudes from the side wall of the upper part of the housing 12, and within the housing it is supported for rotation by a bearing sleeve 23 anchored to the frame 11. Rigidly secured to the bearing sleeve 23 and lying on the outer face of the housing 11 is a fixed bracket 24, the shaft 22 projecting outwardly from the sleeve 23 and bracket 24. Adjacent the exterior of the housing 12 the shaft 22 carries first and second parallel and axially spaced ratchet discs 25, 26 which are anchored to the shaft 22 for rotation therewith. The ratchet teeth on the disc 25 are inclined in a clockwise direction while the ratchet teeth of the disc 26 are inclined in a counter-clockwise direction.

Supported for rotation on the shaft 22 adjacent the ratchet disc 26 is an angularly movable manual operating lever 27 which projects radially outwardly with respect to the shaft 22 and has a moulded knob 28 at its free end. Pivotally mounted on the face of the lever 27 presented towards the ratchet discs 25, 26 are first and second pivotal pawls 29, 31 the pawl 29 being aligned with the ratchet disc 25 and the pawl 31 being aligned with the ratchet disc 26. Both pawls are resiliently urged to pivot relative to the lever 27 to engage their free ends with the perphiery of the respective ratchet disc. The mechanism whereby the pawls 29, 31 are resilient urged towards their respective discs is not illustrated in FIG. 2, but FIGS. 3 and 4 show diagrammatically the presence of helical compression spring 32 acting between the pawls to urge them to pivot about their respective supporting pins in a direction to engage their free ends with the periphery of their respective ratchet disc.

The free end of the shaft 22 protrudes beyond the lever 27, and secured thereto at the outer face of the lever 27 is a hand wheel 33. Extending from the bracket 24 parallel to the axis of the shaft 22 is a spindle 34 to which is pivotally connected one end of a spring operated centering unit 35. The opposite end of the unit 35 is pivotally connected to a protrusion 36 of the lever 27, the action of the unit 35 being to return the lever 27 to a central, rest position from which is can be moved angularly in either direction about the axis of the shaft 22. Also secured to the bracket 24 and extending parallel to the shaft 22 is a pawl lifting cam 37 which projects between the pawls 29, 31 and, in the central, rest position of the lever 27, lifts both pawls out of engagement with their respective ratchet discs. Thus in the central, rest position of the lever, since neither of the pawls 29, 31 is engaged with its respective ratchet disc, the shaft 22 is free to rotate relative to the lever 27.

The operation of the centering unit 35 is best understood by reference to FIG. 5 wherein it can be seen that the centering unit 35 includes a cylindrical housing 38 having a shackle 39 at one axial end by means of which the housing is pivotally mounted on the spindle 34. Protruding from the opposite end of the housing is a push-rod 41 having a shackle 42 at its free end whereby the push-rod is pivotally connected to the protrusion 36 of the lever 27. Loosely mounted on the push-rod 41 within the housing 38 are first and second flanged sleeves 43, 44 which are urged away apart by a helically wound compression spring 45. In the rest position of the unit 35 (which corresponds to the central, rest position of the lever 27) the sleeve 43 abuts a shoulder 46 on the housing and a shoulder 47 on the push-rod 41 while the sleeve 44 abuts a shoulder 48 on the housing and a shoulder 49 on a collar 51 anchored to the push-rod 41. If the lever 27 is moved in one angular direction from its central, rest position then the push-rod 41 is depressed into the housing 38 so that the shoulder 47 abutting end of the sleeve 43 drives the sleeve 43 towards the sleeve 44 thus compressing the spring 45. Upon release of the lever the spring 45 restores the sleeve 43 to abutment with the shoulder 46 thus restoring the lever to its central, rest position. Similarly, if the lever is moved in the opposite direction from its rest position then the push-rod 41 is withdrawn relative to the housing 38 and the collar 51 abutting the sleeve 44 moves the sleeve 44 towards the sleeve 43 again compressing the spring 45. Upon release of the lever the spring 45 returns the sleeve 44 to abutment of the shoulder 48 and in so doing returns the lever to its central, rest position. Conveniently the spring 45 is pre-stressed during assembly of the unit 35 so as to be under at least slight compression in the central, rest position of the unit 35 and lever 27.

The operation of the press is as follows. Assuming that the movable press tool engaged in the carrier 15 is clear of a workpiece to be operated upon, then there will be no resistance to movement of the carrier 15 and in order to bring the tool into engagement with the workpiece it will be necessary to rotate the shaft 16 through a predetermined number of revolutions dependent upon the gap between the tool and the workpiece. An operator will thus ensure that the lever 27 is released, and is thus in its central, rest position under the action of the centering unit 35. As mentioned above in this position the cam 37 lifts both pawls 29, 31 out of engagement with their corresponding ratchet discs so that the shaft 22 is free to rotate relative to the lever 27. The operator rotates the shaft 22 by means of the hand wheel 33 thus rotating the shaft 16 by virtue of the gears 19, 21, until the moving tool of the carrier 15 engages the workpiece. Thereafter the operator will grasp the knob 28 of the lever 27 and will apply a force to the lever 27 to move it angularly about the axis of the shaft 22. For convenience let us assume that the movement of the lever is downwards in FIG. 1, that is to say clockwise in a FIGS. 3 and 4. Immediately the lever 27 moves from the central, rest position the pawl 31 will be moved off the cam 37 and under the action of the spring 32 will engage the ratchet teeth of the ratchet disc 26. Thus the disc 26 and therefore the shaft 22 will be coupled by the pawl 31 to the lever 27 and the shaft 22 and the shaft 16 will be moved angularly with the lever 27. It will be recognised that the lever 27 affords the same type of control over the rotation of the shaft 16 can be exercised by the hand wheel illustrated in British Pat. patent 2119682. However operation by means of a lever movable in a vertical plane is of course greatly more convenient.

During movement of the lever 27 in a clockwise direction the pawl 29 remains lifted by the cam 37. However, if the movement of the lever 27 is from the central, rest position in a counter-clockwise direction then the pawl 31 remains lifted by the cam 37 and the pawl 29 cooperates with the ratchet teeth of the ratchet disc 25 to couple the shaft 22, and therefore the shaft 16, to the lever 27 for counter-clockwise movement. Abutments (not shown) are provided for restricting the angular freedom of the lever 27 on opposite sides of its rest position, and the arcuate length of the cam 37 is chosen in relation to the freedom of movement of the lever 27 such that the limit of movement of the lever 27 is reached before the non-operative pawl would clear the opposite end of the cam 37.

If desired the housing can include an extension within which the ratchet pawl arrangement is received both to protect the arrangement from ingress of dirt, and to provide a greater degree of protection for an operator.

If desired locking means can be provided for locking the lever in an actuated position relative to the housing thereby avoiding the necessity for an operator to hold the lever in position for example where pressure is to be applied to a workpiece for a predetermined length of time. The locking means can have preset locking positions or can be arranged to lock the lever in any chosen position.

Although it is preferred that the lever 27 shall coupled to the shaft 22 for movement in either direction from the rest position by means of a pawl and ratchet arrangement, it is to be understood that other forms of coupling could be utilized. For example, there is a form of coupling which relies upon the tightening of a helically wound wire to provide a friction grip on a shaft. A pair of such devices, oppositely orientated, could be provided in place of the ratchet and pawl arrangement it being understood that there would still be a central rest position in which neither of the devices was operative, so that the shaft 22 could be rotated relative to the lever 27 to provide "coarse" adjustment of the position of the movable tool of the press.

Torque applied to the shaft 16 when the carrier 15 is not free to move causes twisting of a torsion bar which in turn controls operation of a variable hydraulic valve. Assuming that consequent upon the increase in hydraulic pressure the carrier 15 moves then of course the torsion in the torsion bar is revealed. However if the carrier 15 cannot move then the torsion is maintained until released by reverse rotation of the shaft 16. The torsion bar will act as a return spring for the shaft 16 when the shaft is released. It will be understood that applying this mode of operation to the arrangement utilizing the lever 27, then when force has been applied by means of the lever 27 and the carrier 15 has not been able to move then upon release of the lever 27 the shaft 22 will rotate back with the lever 27 as the lever 27 is returned by the unit 35 to its central rest position, it being understood that the return rotation of the shaft 22 is by virtue of the "unwinding" of the torsion bar, there being no drive connection between the shaft 22 and the lever 27 during such return movement unless the shaft is returned at an angular speed greater than that of the lever, in which case the shaft will, by virtue of the ratchet and pawl, assist in centering the lever.

We claim:

1. An hydraulic press having a fixed tool carrier, a movable tool carrier, a first rotatable shaft for generating movement of the movable tool carrier towards and away from the fixed tool carrier, said shaft having its axis aligned with the direction of movement of the movable tool carrier, a second rotatable shaft extending transverse to said first rotatable shaft, drive transmission means coupling said first and second shafts, an angularly movable, manual operating lever, centering means urging said lever to a central, rest position from which said lever is movable manually in opposite angular directions, and, coupling means for coupling said lever to said second shaft during angular movement of the lever in either direction from said central, rest position, said shaft being rotatable relative to said lever in said central, rest position.

2. An hydraulic press as claimed in claim 1 wherein said lever is angularly movable about the axis of said second shaft.

3. An hydraulic press as claimed in claim 1 or claim 2 wherein said coupling means comprises first and second ratchet discs rotatable with said second shaft, respective first and second pawls carried by said lever and cooperable respectively with said first and second ratchet discs, said first pawl cooperating with said first ratchet disc during clockwise angular movement of the lever so as to transmit such clockwise movement of the lever to said second shaft, said second pawl cooperating with said second ratchet disc during counter-clockwise movement of the lever so as to transmit such counter-clockwise movement of the lever to said second shaft, and, the coupling means further including pawl lifting means operable in the central rest position of the lever to disengage both of said first and second pawls from their respective ratchet discs.

* * * * *